US006367114B1

(12) United States Patent
Babkowski

(10) Patent No.: US 6,367,114 B1
(45) Date of Patent: Apr. 9, 2002

(54) PAINT BRUSH HAVING CRINKLE FILAMENTS AND NATURAL BRISTLES

(75) Inventor: William I. Babkowski, Salisbury, MD (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 09/219,670

(22) Filed: Dec. 23, 1998

Related U.S. Application Data

(60) Provisional application No. 60/071,026, filed on Jan. 13, 1998.

(51) Int. Cl.[7] ..... A46B 15/00; A46B 9/00

(52) U.S. Cl. ..... 15/207.2; 15/DIG. 6

(58) Field of Search ..... 15/207.2, DIG. 6; 427/429

(56) References Cited

U.S. PATENT DOCUMENTS

| | | | | |
|---|---|---|---|---|
| 2,790,986 A | | 5/1957 | Schwartz et al. | |
| 3,072,944 A | * | 1/1963 | Clayton | 15/207.2 |
| 3,344,457 A | | 10/1967 | Grobert | |
| 4,285,088 A | | 8/1981 | Ripstein | |
| 4,307,478 A | | 12/1981 | Ward et al. | 15/159 A |
| 4,409,372 A | | 10/1983 | Ward et al. | 525/425 |
| 4,937,141 A | | 6/1990 | Burns | 428/376 |
| 5,161,555 A | | 11/1992 | Cansler et al. | 132/218 |
| 5,195,546 A | | 3/1993 | Cansler et al. | 132/317 |
| 5,359,749 A | | 11/1994 | Chu | |
| 5,491,865 A | | 2/1996 | Gueret | |
| 5,701,629 A | | 12/1997 | O'Brien | |
| 5,770,307 A | | 6/1998 | Rackley et al. | |

FOREIGN PATENT DOCUMENTS

| | | | |
|---|---|---|---|
| CH | 15641 | * 12/1897 | 15/DIG. 6 |
| DE | 560528 | * 10/1932 | 15/DIG. 6 |
| DE | 2757046 | * 7/1979 | 15/207.2 |
| GB | 598821 | 2/1948 | |
| GB | 645822 | 11/1950 | |
| WO | WO 98/33414 | 8/1998 | |

OTHER PUBLICATIONS

Derwent Publications Ltd., London, GB; Class A23, AN 93–357912 XP002102620 & JP 05 074479 B (Teijin Ltd.) Oct. 18, 1993.

* cited by examiner

*Primary Examiner*—Randall E. Chin
(74) *Attorney, Agent, or Firm*—Robert E. McDonald; Vivien Y. Tsang; James A. Hudak

(57) ABSTRACT

A paint brush which incorporates a mixture of natural bristles and synthetic crinkle filaments is disclosed. The natural bristle can be hog bristle, or the like, and the synthetic crinkle filaments can be formed from a polyester resin and include a plurality of waves or crimps along their length. The paint brush retains its shape through use and the bristles do not become "floppy" when used with water-based paint. In addition, the paint brush provides excellent paint "pick-up" and release properties and has superior surface coverage capabilities.

5 Claims, 2 Drawing Sheets

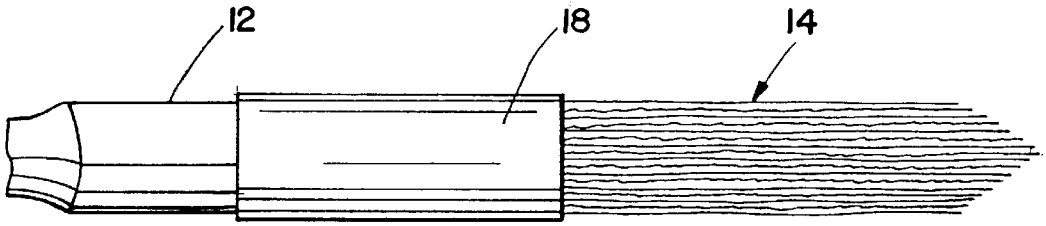
Fig. 3
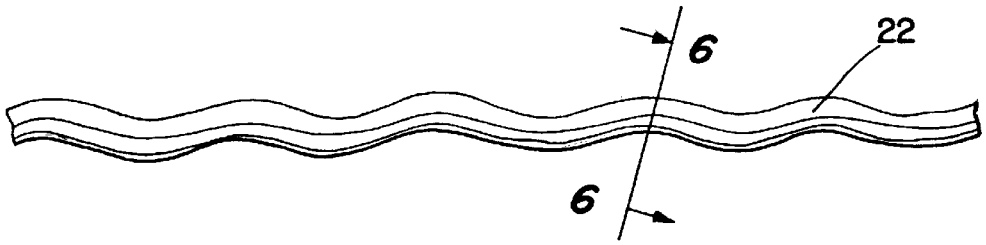
Fig. 4
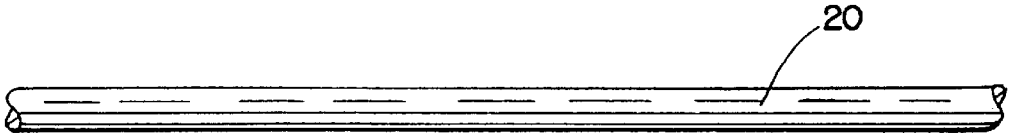
Fig. 5
Fig. 6
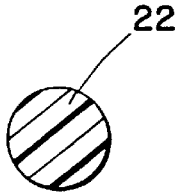

PAINT BRUSH HAVING CRINKLE FILAMENTS AND NATURAL BRISTLES

This application claims the benefit of U.S. Provisional Application(s) No(s).: 60/071,026 Jan. 13, 1998.

TECHNICAL FIELD

The present invention relates, in general, to a paint brush and, more particularly, to a paint brush that utilizes both natural bristles, i.e., animal hairs, and synthetic filaments to provide excellent paint "pick-up", release and superior surface coverage capabilities.

BACKGROUND ART

Paint brushes utilizing natural bristles, and especially hog bristles, are usually preferred by professional painters when applying oil-based paints. Hog bristles are naturally tapered and provide excellent paint "pick-up", release and paint coverage. When paint brushes incorporating hog bristles are used with water-based paints, the bristles, however, become very floppy since they absorb moisture from the paint. As a result, the use of hog bristle paint brushes is typically limited to oil-based paints.

In view of the fact that hog bristles absorb water, the paint industry has developed brushes incorporating synthetic fiber bristles for use with water-based paints. Such synthetic fiber bristles will not absorb moisture and do not become floppy during use. Synthetic fiber bristles, however, are somewhat inferior to hog bristles with respect to paint "pick-up" and release and result in less surface coverage.

Because of the foregoing, it has become desirable to develop a paint brush incorporating synthetic filaments having a wavy or crinkle configuration along their longitudinal axis and combining the same with natural bristles resulting in a brush that provides excellent results when used with water-based paints.

SUMMARY OF THE INVENTION

The present invention overcomes the problems associated with using natural bristle, especially hog bristle, paint brushes with water-based paints and other problems by providing a paint brush that incorporates a mixture of natural bristles with synthetic filaments having a wavy or crinkle configuration along their longitudinal axis. The mixture of natural bristles and synthetic crinkle filaments results in a paint brush that does not become floppy when used with water-based paints and which has excellent paint "pick-up" and release properties, and provides superior surface coverage with an excellent finish.

Accordingly, an object of the present invention is to provide a paint brush which can be readily used with water-based paints.

Another object of the present invention is to provide a paint brush incorporating both natural bristles and synthetic crinkle filaments.

Still another object of the present invention is to provide a paint brush incorporating both natural bristles and synthetic crinkle filaments and wherein the synthetic crinkle filaments have a wavy configuration along their longitudinal axis.

A further object of the present invention is to provide a paint brush which has excellent paint "pick-up" and release properties and superior coverage capabilities.

BRIEF DESCRIPTION OF THE DRAWINGS

FIG. 3 is a front elevational view of the paint brush of the present invention.

FIG. 4 is an enlarged front elevational view of a synthetic crinkle filament utilized in the paint brush of the present invention.

FIG. 5 is an enlarged front elevational view of a natural bristle utilized in the paint brush of the present invention.

FIG. 6 is a cross-sectional view taken across section-indicating lines 6—6 in FIG. 4 illustrating the cross-section of a synthetic crinkle filament.

DESCRIPTION OF THE PREFERRED EMBODIMENT

Figure 1:
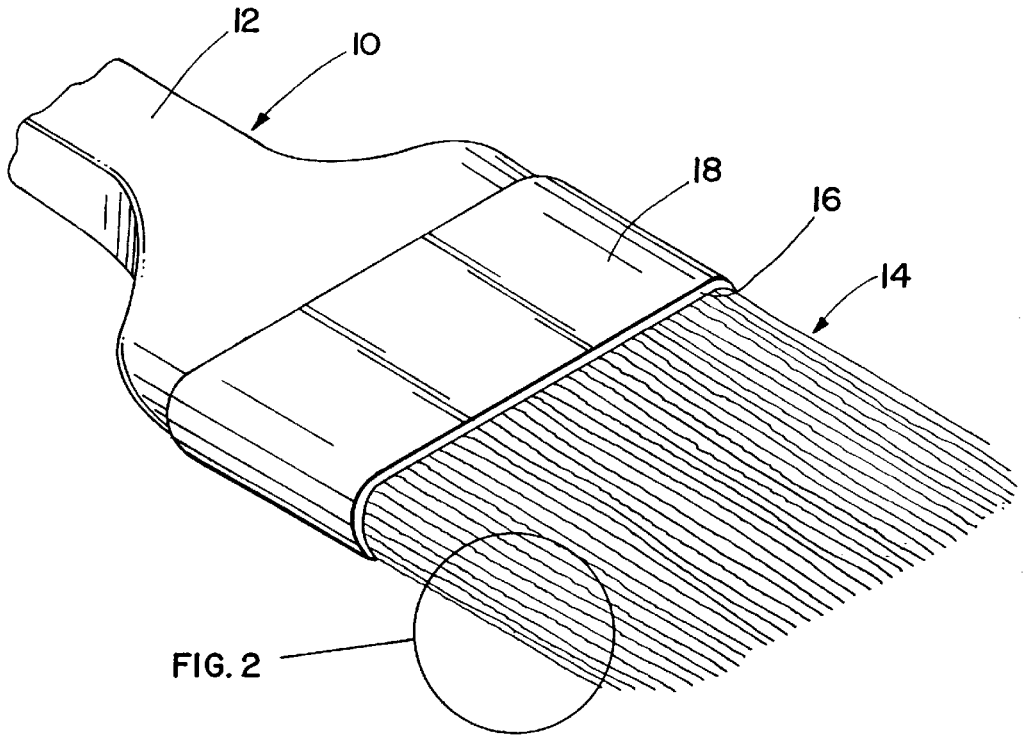
FIG. 1 is a perspective view of the paint brush of the present invention illustrating the utilization of natural bristles and synthetic crinkle filaments therein.

Referring now to the drawings where the illustrations are for the purpose of describing the preferred embodiment of the present invention and are not intended to limit the invention described herein, FIG. 1 is a perspective view of the paint brush 10 of the present invention. The paint brush 10 includes a handle 12 made from either wood or plastic and which may be finished with a protective coating, such as urethane, or remain unfinished. One end of a mixture of bristles 14 is received within an insert (not shown) and is retained therein by a standard technique, such as gluing with an epoxy resin, or the like. The insert with the mixture of bristles 14 attached thereto is received within the open end 16 of a ferrule 18. The opposite end of the ferrule 18 is received over the periphery of the end of the handle 12 and is attached thereto by nailing, or by some other attachment method.

Figure 2:
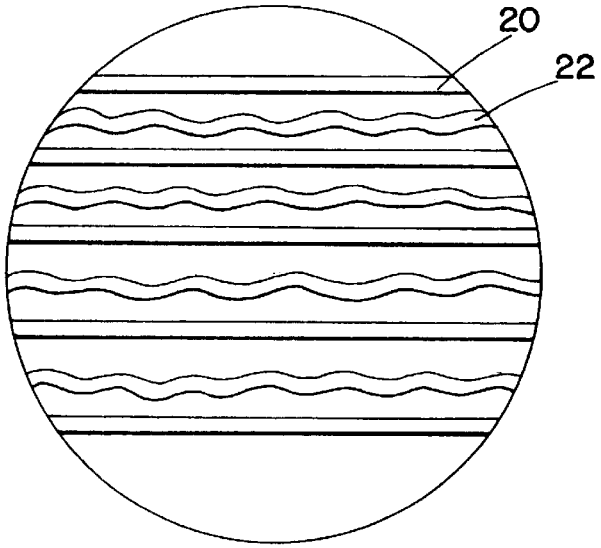
FIG. 2 is an enlarged cross-sectional view illustrating the natural bristles and synthetic crinkle filaments within the paint brush of the present invention.

The mixture of bristles 14 is comprised of a plurality of natural bristles 20 and a plurality of synthetic crinkle filaments 22, as shown in FIG. 2. The natural bristles 20 can be hog bristles, horse hair, squirrel hair, sable hair, or the like. The bristles 20 are generally circular in cross-section and typically have a tapered tip. For example, the bristles 20 typically have a base diameter of about 0.012 inches and a tip diameter of 0.008 inches. In addition, the overall length of the natural bristles 20 can vary, that is, a portion of the plurality of bristles 20 can be a first length, a second portion of the bristles 20 can be slightly shorter in length, and the remaining portion of the bristles 20 can be still slightly shorter in length. Thus, the exposed length of the plurality of natural bristles captured within ferrule 18 can vary. Furthermore, the relative number of natural bristles 20 to synthetic crinkles filaments 22 within the mixture of bristles 14 can vary. Preferably, the mixture would comprise at least 20% by weight natural bristles and at least 20% by weight synthetic crinkle filaments and optionally could contain other types of filaments, such as polyamide (including nylon), polyester, or polyurethane filaments which would not be intentionally kinked or deformed, and would not have a characteristically wavy configuration along their longitudinal axis. These conventional synthetic filaments would be substantially linear along their longitudinal axis.

In one preferred example, the mixture of bristles 14 can comprise about 40 to 60% by weight natural bristles with the remainder preferably being synthetic crinkle filaments 22. Optimally, for many applications, the mixture of bristles 14 should be comprised of about 50% by weight natural bristles and about 50% by weight synthetic crinkle filaments.

The synthetic crinkle filaments 22 are preferably extruded from a polyester resin, such as polybutylene terephthlate, according to conventional practice. The synthetic crinkle filaments 22 are generally circular in cross-section and typically have a tapered tip. If the synthetic crinkle filaments are not tapered, they will generally have a diameter of at least about 0.005 inches, and preferably will have a diameter between 0.005 and 0.025 inches. If the synthetic filaments are tapered, they will generally have a base diameter of at least about 0.008 inches and preferably will have a base diameter between 0.008 and 0.025 inches. The tip diameter of a tapered filament will typically be at least about 0.005 inches and preferably will have a tip diameter between 0.005 and 0.015 inches. For example, in one preferred embodiment, the filaments 22 may have a base diameter of 0.012 inches and a tip diameter of 0.008 inches, each diameter having a tolerance of plus or minus 15%. Alternatively, in another preferred embodiment, the filaments 22 may have a base diameter of 0.015 inches am a tip diameter of 0.010 inches, each diameter having a tolerance of plus or minus 15%. In addition, each synthetic crinkle filament 22 is crimped along its longitudinal axis utilizing conventional crimping apparatus to impart an average of about 4 to 12 crimps per inch in the longitudinal direction, and preferably about 8 crimps plus or minus 1 crimps per inch in the longitudinal direction, as shown in FIG. 4. The amplitude of each crimp in the filament 22 typically average at least about 0.010 inches and is especially preferred to average about 0.018 inches plus or minus 0.003 inches. Although it is generally preferred to utilize synthetic crinkle filaments having crimps which are substantially regular in both frequency and amplitude, it is possible for some applications to utilize filaments whose crimps are random and irregular in both frequency and amplitude. One representative method of preparing synthetic crinkle filaments having irregular crimps is to gather a plurality of monofilament synthetic bristles and pass them between a pair of gear wheels having rounded and irregular gear teeth. This is contrary to conventional crimping which is accomplished in one representative manner by passing the filaments in a spread-apart manner through regularly spaced crimping gears. Representative commercial synthetic filaments are available from Specialty Filaments, Inc. of Odenton, Md. One preferred commercial sample is Ketlar 382248 tapered polyester filaments from Specialty Filaments.

In a standard test utilized by manufacturers of paint and/or paint brushes, a three (3) inch wide paint brush containing a plurality of natural bristles 20 and a plurality of synthetic crinkle filaments 22 was tested. The brush thickness was 7/8 of an inch and the overall trim length of the bristles was 3 7/16 inches. After repeated dips of the brush in paint, the average paint "pick-up" per dip was 48.0 grams and the average paint release was 9.7 grams resulting in the average amount of paint available for surface coverage being 9.7 grams. Thus, the paint brush 10 comprising a mixture of natural bristles 20 and synthetic crinkle filaments 22 had excellent paint "pick-up" and release capability. In addition, in coverage tests, the average paint coverage for the aforementioned brush was 204 square inches, which is substantially greater than that possible with a similar paint brush typically used by professional painters. Therefore, the paint brush 10 utilizing a mixture of natural bristles 20 and synthetic crinkle filaments 22 has excellent paint "pick-up", release and superior coverage capabilities.

Certain modifications and improvements will occur to those skilled in the art upon reading the foregoing. It should be understood that all such modifications and improvements have not been expressly set forth herein for the sake of conciseness and readability, but are properly within the scope of the following claims.

I claim:

1. A paint brush comprising a handle and a mixture of bristles extending from one end of said handle, said mixture comprising natural bristles and crinkle filaments formed of a synthetic resin, said crinkle filaments having a wavy configuration in amplitude and frequency along their longitudinal axis, said mixture comprising at least about 20% by weight of said natural filaments and at least about 20% by weight of said crinkle filaments.

2. The paint brush as described in claim 1 wherein said synthetic crinkle filaments are formed from a polyester resin.

3. The paint brush as described in claim 2 wherein said polyester resin is polybutylene terephthlate.

4. The paint brush as described in claim 1 wherein 40 to 60% by weight of the bristles in said mixture of bristles are natural bristles.

5. A paint brush comprising a handle and a mixture of bristles extending from one end of said handle, said mixture of bristles comprising natural bristles and crinkle filaments formed of a synthetic resin, said crinkle filaments having a wavy configuration in amplitude and frequency along their longitudinal axis, said crinkle filaments having crimps therein with an amplitude averaging at least about 0.010 inches along their longitudinal axis to impart a wavy configuration thereto.

* * * * *